US008477155B2

(12) United States Patent
Huang et al.

(10) Patent No.: US 8,477,155 B2
(45) Date of Patent: Jul. 2, 2013

(54) DISPLAY METHOD, DISPLAY CONTROLLER AND DISPLAY TERMINAL

(75) Inventors: Jun Huang, Shenzhen (CN); Yuan Ji, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 687 days.

(21) Appl. No.: 12/798,392

(22) Filed: Apr. 2, 2010

(65) Prior Publication Data

US 2010/0253836 A1 Oct. 7, 2010

(30) Foreign Application Priority Data

Apr. 3, 2009 (CN) ..... 2009 1 0130039

(51) Int. Cl.
*G09G 5/00* (2006.01)

(52) U.S. Cl.
USPC ..... 345/660; 375/240.28

(58) Field of Classification Search
USPC ..... 345/660; 375/240.28
See application file for complete search history.

(56) References Cited

U.S. PATENT DOCUMENTS 4,715,059 A * 12/1987 Cooper-Hart et al. ..... 348/14.14
5,812,786 A * 9/1998 Seazholtz et al. ..... 709/233
6,100,906 A * 8/2000 Asaro et al. ..... 345/539
6,188,381 B1 * 2/2001 van der Wal et al. ..... 345/581
7,710,434 B2 * 5/2010 Gu ..... 345/589
8,279,946 B2 * 10/2012 Mak-Fan et al. ..... 375/240.28
2003/0227460 A1 12/2003 Schinnerer
2004/0055011 A1 * 3/2004 Bae et al. ..... 725/62
2006/0031886 A1 * 2/2006 Bae et al. ..... 725/62
2006/0037050 A1 * 2/2006 Bae et al. ..... 725/62
2007/0182852 A1 8/2007 Wu et al.
2007/0285439 A1 12/2007 King et al.
2008/0255943 A1 * 10/2008 Morten et al. ..... 705/14
2008/0297532 A1 * 12/2008 Gu ..... 345/600
2009/0135918 A1 * 5/2009 Mak-Fan et al. ..... 375/240.28

FOREIGN PATENT DOCUMENTS

CN 1981519 A 6/2007

* cited by examiner

*Primary Examiner* — M Good Johnson

(57) ABSTRACT

A display method and apparatus are disclosed. The method includes: when a video layer needs to scale a video image, judging whether a preset policy is met; if so, using the offline mode; otherwise using the online mode; processing the video image in online mode or offline mode, and outputting the processed video image, where the online mode is a mode in which the video image frame is scaled in real time, and the offline mode is a mode in which the video image frame is scaled asynchronously. With the display method and apparatus, the source video image can be scaled in any ratio by selecting the online mode or offline mode, thus reducing the display power consumption.

17 Claims, 11 Drawing Sheets

FIG. 1 （PRIOR ART）

DISPLAY METHOD, DISPLAY CONTROLLER AND DISPLAY TERMINAL

CROSS-REFERENCE TO RELATED APPLICATIONS

This application claims priority to Chinese Patent Application No. 200910130039.4, filed on Apr. 3, 2009, which is hereby incorporated by reference in its entirety.

FIELD OF THE INVENTION

The present invention relates to display technologies, and in particular, to a display method, display controller and display terminal.

BACKGROUND

Currently, video play and video telephony are used extensively on mobile terminals. To display a high-resolution video source on a low-resolution liquid crystal display (LCD), a process of scaling down the video source is generally required. On the contrary, to display a low-resolution video source on a high-resolution LCD, a process of scaling up the video source is required.

The source video is scaled by a scaling engine integrated in the display controller. FIG. 1 shows a structure of a display controller in the prior art. As shown in FIG. 1, the display controller 120 is synchronized with the display frame rate, and reads the source video image and other image layers from the system memory 110. The display controller 120 integrates a video channel 121, a rotating module 122, a scaling engine module 123, and a YUV-RGB converting module 124. The display controller 120 rotates the source video image, scales the source video image, and converts the pixel format of the source video image in real time (optional). The overlay processing module 125 overlays the processed video image with other image layers for displaying, and then sends the overlaid image to the LCD 130 for displaying. According to the foregoing structure, the scaling engine module 123 is integrated into the display controller 120 to scale the source video image in real time.

In the prior art, the transient bandwidths required for reading the source video image linearly increase along with the scaling ratio. The transient bandwidths needed by the system memory to read the source video image under scaling conditions=transient bandwidths needed by the system memory to read the source video image in case of no scaling*vertical scaling ratio*horizontal scaling ratio. Table 1 lists maximum input video resolutions that can be supported by the scaling engine of the display controller supplied by a renowned application processor supplier under various LCD resolutions. As shown in Table 1, the vertical and horizontal scaling ratios supported by the display controller are 2 at most.

TABLE 1

| | | Maximum Input Image Resolution | | |
|---|---|---|---|---|
| | Pixel Clock | Interpolation in 3-tap mode | | Interpolation in 5-tap mode |
| LCD Resolution | Frequency (MHz) | RGB16/YUV422. RGB24 | RGB16/YUV422 | RGB24 |
| QCIF(176 × 144) | 2 | 354 × 288 | Not supported | Not supported |
| CIF(354 × 288) | 8 | 768 × 576 | 768 × 576 | 768 × 576 |
| QVGA(320 × 240) | 6 | 640 × 480 | 768 × 576 | 768 × 576 |
| HVGA(480 × 320) | 12 | 768 × 576 | 768 × 576 | 768 × 576 |
| VGA(640 × 480) | 24 | 1280 × 960 | 768 × 576 | 768 × 576 |
| SVGA(800 × 600) | 37 | 1536 × 1152 | 768 × 576 | 768 × 576 |
| XVGA(1024 × 768) | 61 | 1536 × 1152 | 768 × 576 | 768 × 576 |

During the implementation of the present invention, the inventor discovers at least the following weaknesses in the prior art: The source video image cannot be scaled within a high ratio range in online mode.

SUMMARY

Embodiments of the present invention provide a display method, display controller and display terminal to increase the scaling ratio of the source video image.

A display method provided in an embodiment of the present invention includes:

judging whether a preset policy is met when the video layer needs to scale a video image; if the preset policy is met, using an offline mode; otherwise, using an online mode; and processing a video image frame of the video image according to the online mode or the offline mode, and outputting the processed video image, where the online mode is a mode in which the video image frame is scaled in real time and the offline mode is a mode in which the video image frame is scaled asynchronously.

A display controller provided in an embodiment of the present invention includes:

a mode configuring module, when a video layer needs to scale a video image, adapted to: set the offline mode if a preset policy is met; set the online mode if the preset policy is not met; and a display control processing module, adapted to: control the display controller to process the video image frame according to the online mode or offline mode based on the configuration details of the mode configuring module, and output the processed video image.

A display terminal provided in an embodiment of the present invention includes:

a system memory, adapted to store a video image frame of a video image;

a display controller, when a video layer needs to scale the video image, adapted to: set the offline mode if a preset policy is met; set the online mode if the preset policy is not met, read the video image frame from the system memory according to the online mode or offline mode, process the video image frame, and output the processed video image frame; and a display, adapted to display the processed video image frame processed by the display controller.

With the display method, device and terminal, the source video image can be scaled in a high ratio range by selecting the online mode or offline mode, thus reducing the display power consumption.

BRIEF DESCRIPTION OF THE DRAWINGS

For better description of embodiments of the present invention or technical solution in the prior art, the following briefly describes the required drawings. It is apparent that these drawings are some embodiments of the present invention only, and those skilled in the art may obtain other drawings based on these drawings without creative work.

DETAILED DESCRIPTION OF EMBODIMENTS

The following describes the technical solution of the present invention in detail with reference to the accompanying drawings and exemplary embodiments. These embodiments are some embodiments of the present invention only. Other embodiments that those skilled in the art obtain based on embodiments of the present invention without creative work fall into the scope of protection of the present invention.

Figure 1:
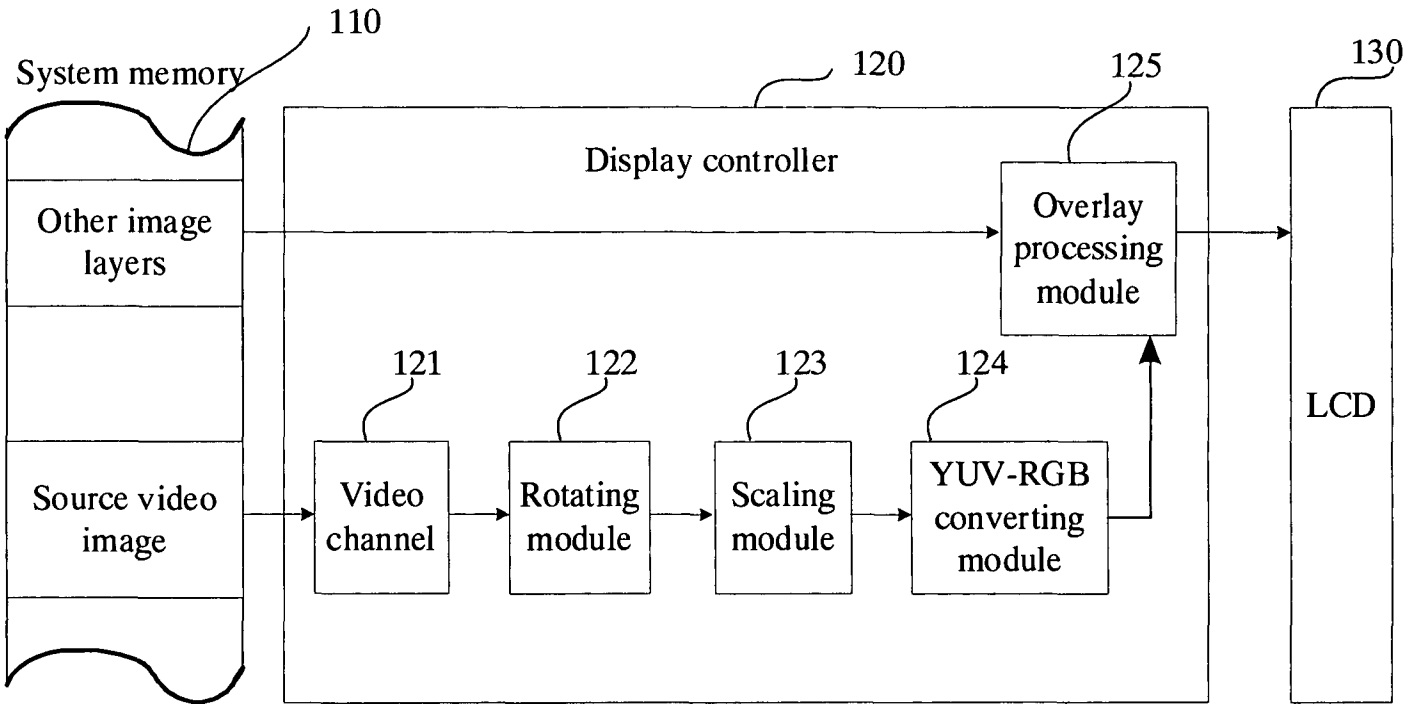
FIG. 1 shows a structure of a display controller in the prior art.
Figure 2:
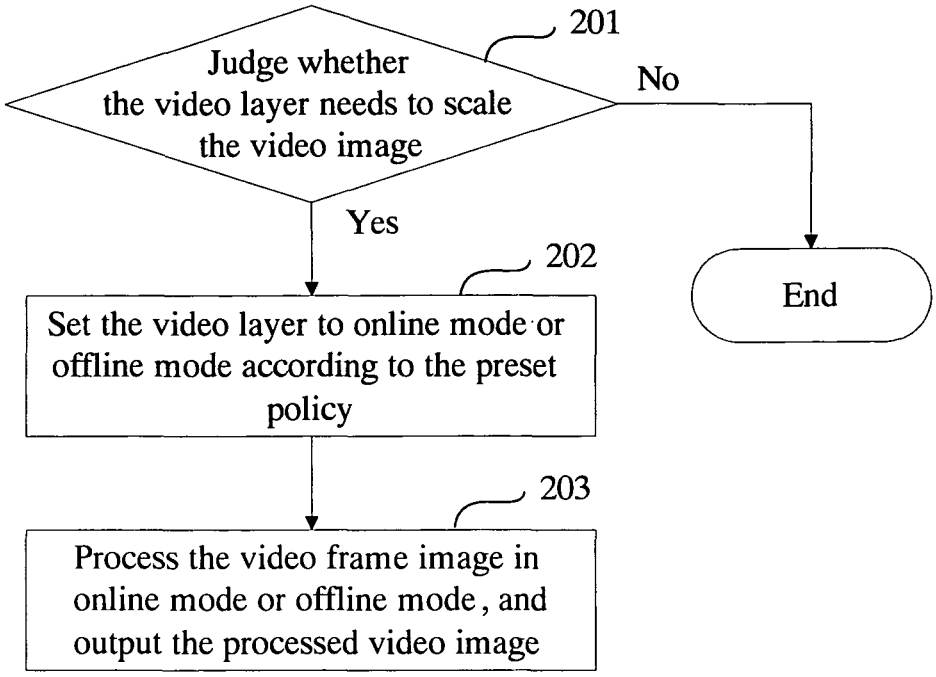
FIG. 2 is a flowchart of a display method in an embodiment of the present invention.

An embodiment of the present invention provides a display method. As shown in FIG. 2, the display method includes:

Step 201: Judge whether the video layer needs to scale the video image; if the video layer needs to scale, go to step 202; otherwise, end the process.

Step 202: Set the video layer to online mode or offline mode according to the preset policy.

The online mode may be a mode in which the scaling engine of the display controller scales the video image in real time. That is, the scaling engine of the display controller sends the processed pixel to the backward module while scaling the video data. The scaling engine and the backward module are streamlined. The offline mode is a mode in which the scaling engine and the backward processing module process the video image asynchronously. That is, the scaling engine writes back the processed data to the scaling buffer of the system memory; after a complete frame is written, a direct memory access (DMA) channel of the display controller reads the frame at the LCD frame synchronization time, and then sends the frame to the backward module of the scaling engine for subsequent processing. In brief, in online mode, the video image frame is scaled in real time; in offline mode, the video image frame is scaled asynchronously.

The preset policy includes a principle of minimizing the data access load of the system memory by the video layer or a principle of minimizing the bus clock frequency of the video layer.

The principle of minimizing the data access load of the system memory by the video layer includes: presetting the display frame rate is M (greater than 1) times the frame rate for writing to the source video image frame buffer and the width and height of the scaled source video image are N times the width and height of the target video image, the ratio of the data access load of the system memory by the video layer in offline mode to the data access load of the system memory by the video layer in online mode is $N^2+M+1:N^2*M$. If the video is played and the decoder writes to the source video buffer, the display rate is generally twice the decoding frame rate, that is M=2. According to the foregoing proportion, when N is greater than 1.73, the data access load of the system memory by the video layer in offline mode is smaller than that in online mode, and the offline mode is selected; when N is smaller than 1.73, the data access load of the system memory by the video layer in online mode is smaller than that in offline mode, and the online mode is selected; when N is equal to 1.73, the data access load of the system memory by the video layer in online mode is equal to that in offline mode, and either the online mode or the offline mode may be selected. That is, the offline mode is used when the horizontal and vertical scaling ratio of the source video image is greater than or equal to $\sqrt{(M+1)/(M-1)}$; the online mode is used when the horizontal and vertical scaling ratio of the source video image is smaller than $\sqrt{(M+1)/(M-1)}$. The $\sqrt{(M+1)/(M-1)}$ can be substituted as $X*\sqrt{(M+1)/(M-1)}$, wherein the X is naturalness number.

The principle of minimizing the bus clock frequency of the video layer includes: using the offline mode when the source video image is scaled down vertically; and using the online mode when the source video image is scaled up vertically.

Step 203: Process the video image according to the online mode or the offline mode, and output the processed video image.

The process shown in FIG. 2 may be explained by using the following steps: When the video layer needs to scale the video image, judge whether the preset policy is met; if the preset policy is met, set the offline mode; otherwise set the online mode; process the video image according to the online mode or the offline mode, and output the processed video image, where the online mode is a mode in which the video image frame is scaled in real time, and the offline mode is a mode in which the video image frame is scaled asynchronously.

The step of judging whether the preset policy is met may include judging whether the preset policy is met according to the principle of minimizing the data access load of the system memory by the video layer. The details are as follows: Presetting the display frame rate is M (greater than 1) times the update frame rate of the video source, when the horizontal and vertical scaling ratio of the source video image is greater than $\sqrt{(M+1)/(M-1)}$, the preset policy is met; when the horizontal and vertical scaling ratio of the source video image is smaller than $\sqrt{(M+1)/(M-1)}$, the preset policy is not met; when the horizontal and vertical scaling ratio of the source video image is equal to $\sqrt{(M+1)/(M-1)}$, the preset policy may be met.

The step of judging whether the preset policy is met may also include judging whether the preset policy is met according to the principle of minimizing the bus clock frequency of the video layer. The details are as follows:

The preset policy is met when the source video image is scaled down vertically; and the preset policy is not met when the source video image is scaled up vertically.

Figure 3:
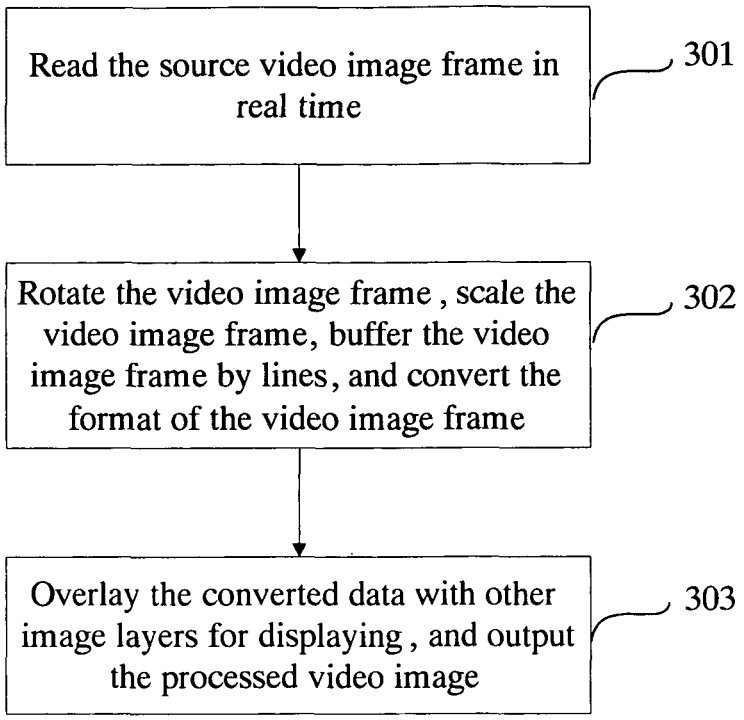
FIG. 3 is a flowchart of processing and outputting a video image frame according to the online mode in an embodiment of the present invention.
Figure 4:
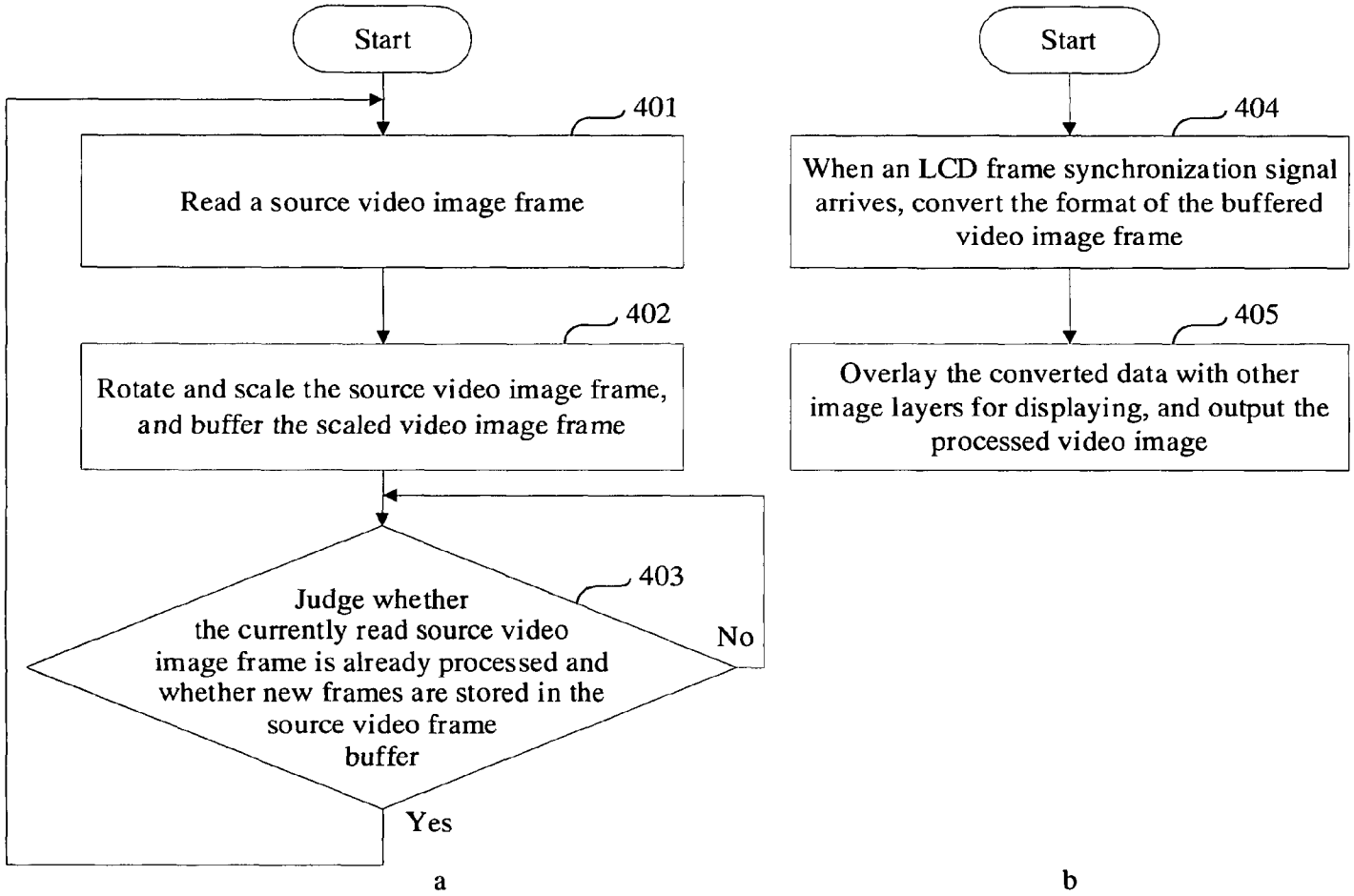
FIG. 4*a* and FIG. 4*b* are flowcharts of processing and outputting a video image frame according to the offline mode in an embodiment of the present invention.

The flowchart of processing the video image frame according to the online mode and outputting the processed video image is shown in FIG. 3. The flowchart of processing the video image frame according to the offline mode and outputting the processed video image is shown in FIG. 4.

With the foregoing display method, the source video image is scaled in a high ratio range according to the online mode or offline mode, thus reducing the display power consumption. In addition, the bus clock frequency and the operating clock frequency of the scaling engine are within a range that can be implemented physically. When the mode is switched according to the principle of minimizing the data access load of the system memory, the data access load of the system memory by the display system can be reduced, thus reducing the power consumption of the system memory. When the mode is switched according to the principle of minimizing the bus clock frequency of the video layer, the bus clock frequency of the video layer can be reduced, thus reducing the total power consumption of the display system.

When the video image frame is read by using the policy of skipping the redundant lines, the operating clock frequency may be reduced, and the data access load of the system memory is further reduced.

Optionally, the step of setting the video layer to online mode or offline mode according to the preset policy may include: using the online mode to scale down the source video image; and using the offline mode to scale up the source video image.

FIG. 3 is a flowchart of processing and outputting a video image frame according to the online mode in an embodiment of the present invention.

Step 301: Read the source video image frame from the source video frame buffer in real time.

Step 302: Rotate the video image frame, scale the video image frame, buffer the video image frame by lines, and convert the format of the video image frame.

The rotation, scaling and format conversion processes are the same as those in the prior art, and are not further described.

The purpose of buffering the video image frame by lines is to solve the problem that the horizontal scaling ratio is limited.

Step 303: Overlay the converted data with other image layers for displaying, and output the processed video image.

The overlay process is the same as that in the prior art, and is not further described.

By processing the video image frame according to the online mode in this embodiment, the video image may be scaled and the scaled video image may be output at the same time. In addition, with the line buffer process, the problem that the horizontal scaling ratio is limited may be solved.

FIG. 4*a* and FIG. 4*b* are flowcharts of processing and outputting a video image frame according to the offline mode in an embodiment of the present invention.

Step 401: Read a source video image frame from the source video frame buffer.

Step 402: Rotate and scale the source video image frame, and buffer the scaled video image frame. That is, write the scaled video image frame to the scaling video buffer.

The rotation and scaling processes are the same as those in the prior art, and are not further described.

Step 403: Judge whether the read source video image frame is already processed and whether new frames are available in the source video frame buffer; if so, return to step 401; otherwise, repeat step 403.

A next source video image frame is read after the previous frame is processed completely.

Step 404: When an LCD frame synchronization signal arrives, read the buffered video image frame from the scaling video buffer, and convert the format of the buffered video image frame.

The format conversion process is the same as that in the prior art, and is not further described.

Step 405: Overlay the converted data with other image layers for displaying, and output the processed video image.

By processing the video image frame according to the offline mode in this embodiment of the present invention, the source video image may be scaled in a high ratio range because the scaling process and subsequent output process are performed asynchronously. In addition, the bus clock frequency and the operating clock frequency of the scaling engine are in a range that can be implemented physically.

Figure 5:
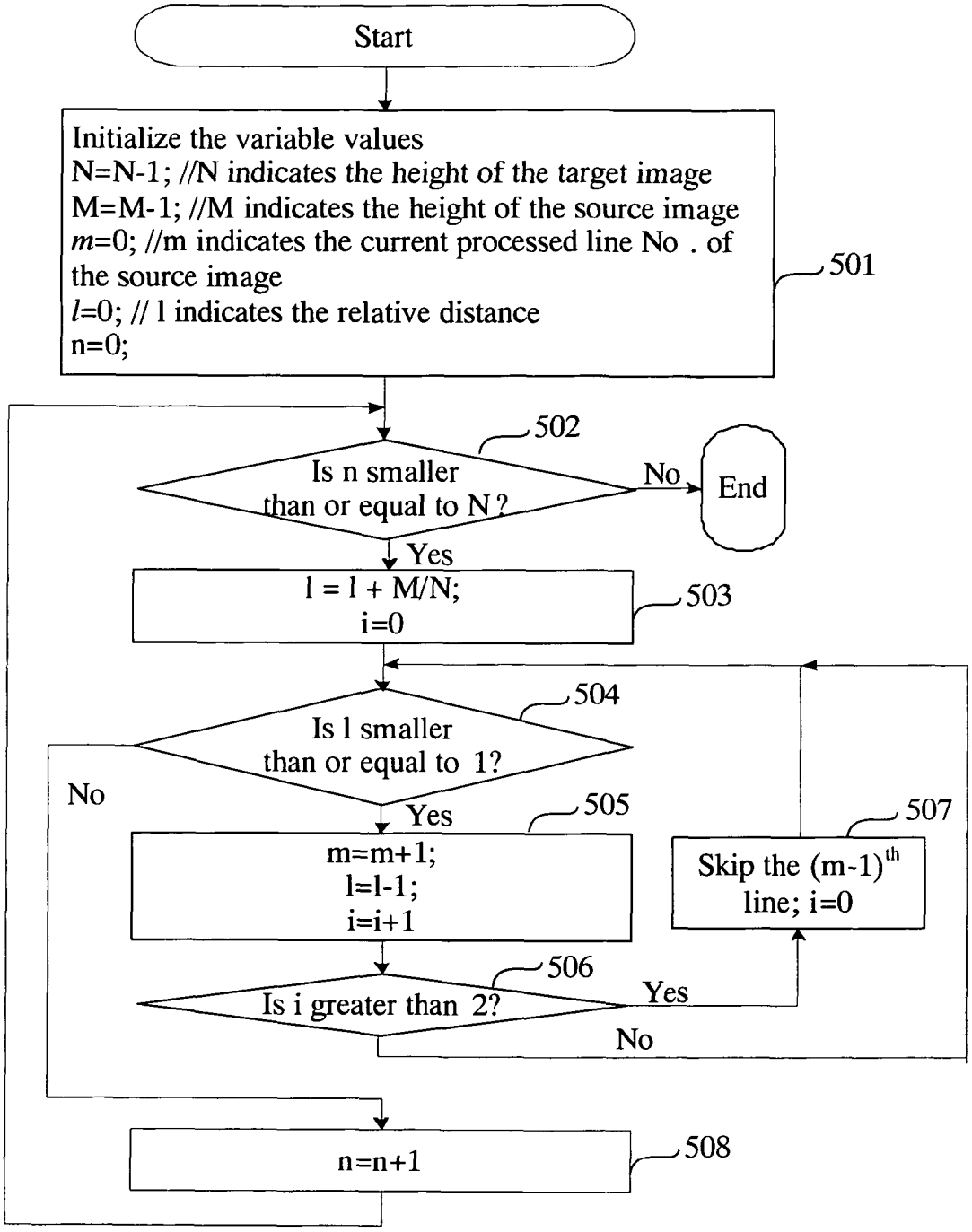
FIG. 5 is a flowchart of a positioning algorithm for determining redundant lines in an embodiment of the present invention.

In embodiments shown in FIG. 3 and FIG. 4, the process of reading the source video image frame in online mode or in offline mode may be implemented in the following two modes: reading all the lines of the source video image; and judging the redundant lines of the read source video image, skipping the redundant lines of the source video-image, and reading non-redundant lines of the video image frame. The redundant lines can be pre judged and skipped directly, and only the valid lines need to be read for subsequent processing. Thus, the operating clock frequency of the scaling engine in offline mode=LCD pixel clock frequency*vertical scaling ratio, which is obviously smaller than the operating clock frequency (=pixel clock frequency*horizontal scaling ratio*(vertical scaling ratio+1)) of the scaling engine in the prior art. In this way, the operating clock frequency may be reduced, and the data access load of the system memory may be further reduced. FIG. 5 is a flowchart of a method for determining redundant lines in an embodiment of the present invention. This embodiment describes a positioning algorithm by taking downsampling in 2-tap mode as an example.

Step 501: Initialize the variable values.

Specifically, the following variables are set: N=N−1; M=M−1; m=0; 1=0; and n=0.

N indicates the height of the target image; M indicates the height of the source image; m indicates the current processed line No. of the source image; and 1 indicates the relative distance.

Step 502: Judge whether n is smaller than or equal to N; if so, go to step 503; otherwise, end the process.

Step 503: Set 1=1+M/N, and i=0.

Step 504: Judge whether I is greater than or equal to 1; if so, go to step 505; otherwise, go to step 508.

Step 505: Set m=m+1, 1=1−1, and I=i+1.

Step 506: Judge whether i is greater than 2; if so, go to step 507; otherwise, go to step 504.

Step 507: Determine the $(m^{-1})^{th}$ line as a redundant line, and return to step 504.

Step 508: Set n=n+1, and return to step 502.

By using the algorithm shown in FIG. 5, the $(m-1)^{th}$ line may be determined as the redundant line. By skipping the redundant line and reading only the valid lines for subsequent processing, the operating clock frequency may be reduced, and the data access load of the system memory may be further reduced.

Figure 6:
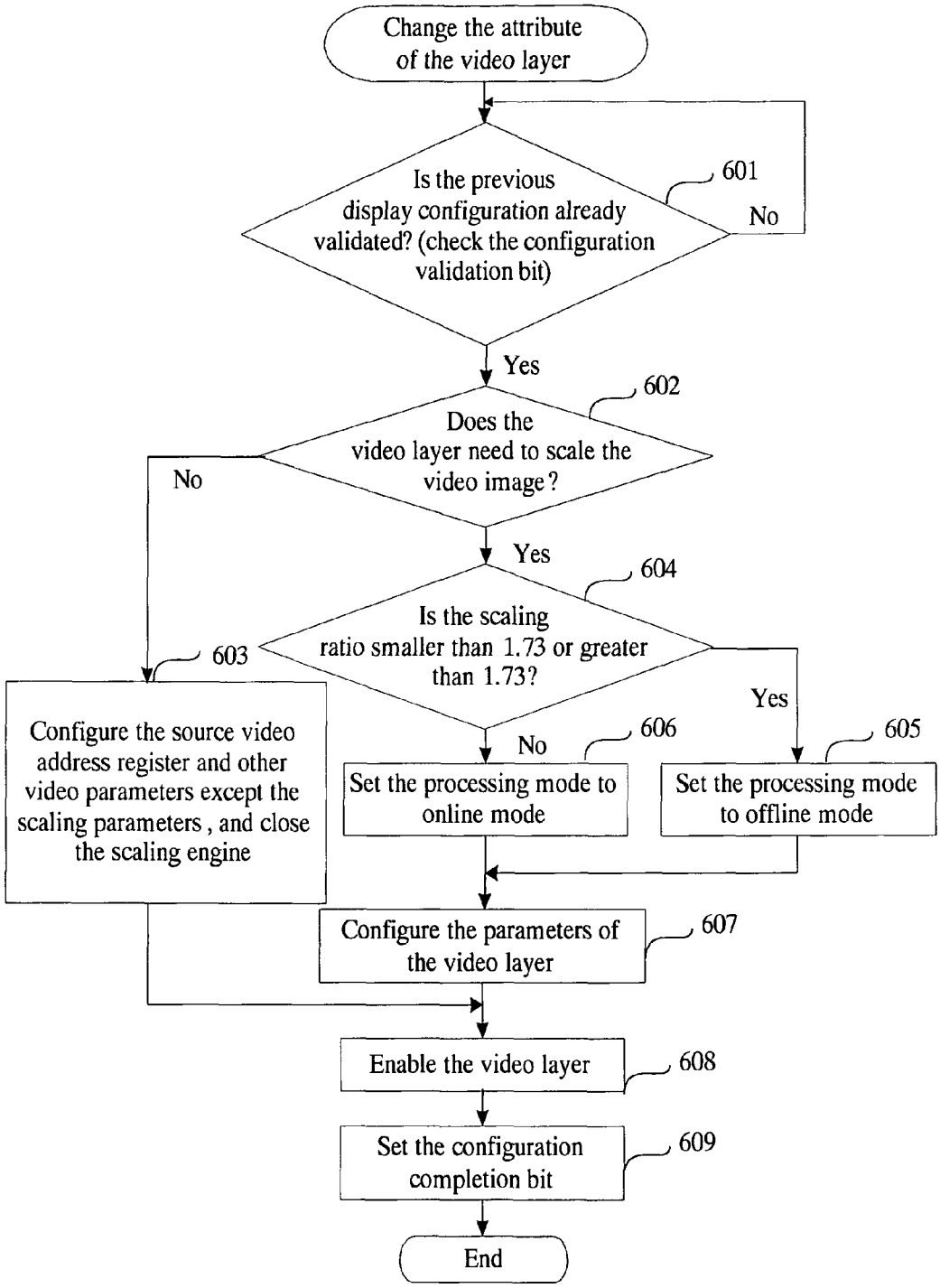
FIG. 6 is a schematic diagram illustrating the mode selection and switching processes according to a principle of minimizing the data access load of a system memory by the video layer in an embodiment of the present invention.

FIG. 6 is a schematic diagram illustrating the mode selection and switching processes according to the principle of minimizing the data access load of the system memory by the video layer in an embodiment of the present invention.

The mode needs to be re-selected and switched if one of the following events occurs:

o1o1 ① The first video image frame is already prepared;

o2o2o2 ② The rotation angle of the video image is changed;

o3o3 ③ The scaling ratio of the video image is changed;

o4o4o4 ④ The overlay priority or overlay specifications (for example, the color key) of the video image layer is changed; or o5o5 ⑤ Background play is changed to foreground play.

The mode selection and switching processes include the following steps:

Step 601: Judge whether the previous display configuration is already validated; if so, go to step 602; otherwise repeat step 601.

In this embodiment, the step of judging whether the previous display configuration is validated is checking whether the configuration validation flag bit is 0. Certainly, in other embodiments, whether the previous display configuration is validated may also be judged by checking whether the configuration validation flag bit is 1.

It is understandable that all the configurations needed for the purpose of display are collectively called display configurations. For a display process, multiple parameters and/or multiple steps need to be configured. It is necessary to judge whether multiple parameters and/or multiple steps for one-time displaying are already configured by checking the configuration bit.

Step 602: Judge whether the video layer needs to scale the video image; if so, go to step 604; otherwise, go to step 603.

Step 603: Configure the source video address register and other video parameters except the scaling parameter, and close the scaling engine, and then go to step 608.

Step 604: Judge whether the scaling ratio of the source video image is smaller than 1.73 or whether the source video image is scaled up; if so, go to step 605; otherwise go to step 606.

Step 605: Set the processing mode to online mode, and then go to step 607.

Step 606: Set the processing mode to offline mode, and then go to step 607.

Step 607: Configure the parameters of the video layer. The parameters of the video layer include at least relationships between the video layer and other image layers, such as overlay priority and color key, video input format such as line offset, width and height of the source image, and width and height of the target image, video rotation angle, scaling video frame buffer address, and scaling parameter register, for example, horizontal and vertical scaling metrics.

Step 608: Enable the video layer.

Step 609: Set the configuration validation flag bit to 1 and end the process.

After the foregoing new configurations are validated, the hardware automatically sets the configuration validation flag bit to 0

Now the mode selection and switching are implemented according to the principle of minimizing the data access load of the system memory by the video layer.

In an embodiment shown in FIG. 6, configuring the parameters of the video layer in step 607 may be executed after step 601 and before step 602.

The mode selection and switching processes according to the principle of minimizing the bus clock frequency of the video layer are the same as those shown in FIG. 6 except for the following differences: In step 604, whether the source video image is scaled down or scaled up is judged; if the source video image is scaled down, go to step 605; otherwise, go to step 606. Other steps are the same as those shown in FIG. 6, and are not further described.

When the mode is switched according to the principle of minimizing the data access load of the system memory, the data access load of the system memory by the display system can be reduced, thus reducing the power consumption of the system memory. When the mode is switched according to the principle of minimizing the bus clock frequency of the video layer, the bus clock frequency of the video layer can be reduced, thus reducing the total power consumption of the display system.

Figure 7:
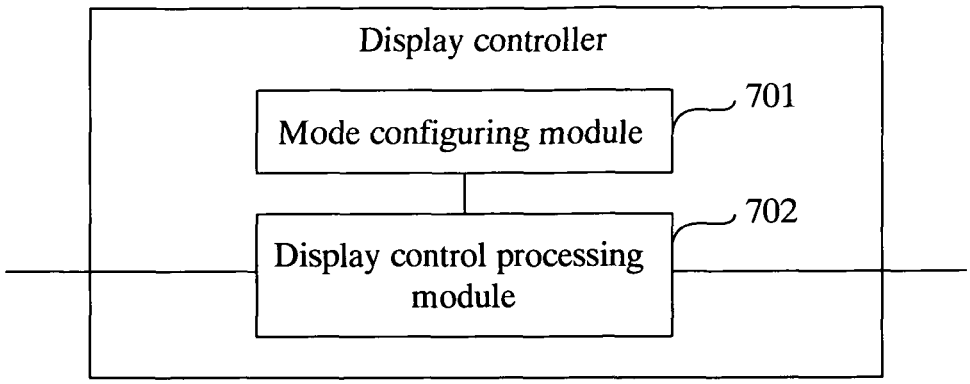
FIG. 7 shows a structure of a display controller in an embodiment of the present invention.

An embodiment of the present invention provides a display controller. As shown in FIG. 7, the display controller includes:

a mode configuring module 701, adapted to: set the offline mode when the preset policy is met and the video layer needs to scale a video image; and set the online mode when the preset policy is not met; or adapted to set the video layer to online mode or offline mode according to the preset policy when determining that the video layer needs to scale the video image; and a display control processing module 702, adapted to: control the display controller to process the video image frame according to the online mode or offline mode based on the configuration details of the mode configuring module, and output the processed video image.

With the display controller, the source video image can be scaled in a high ratio range by selecting the online mode or offline mode, thus reducing the display power consumption.

Figure 8:
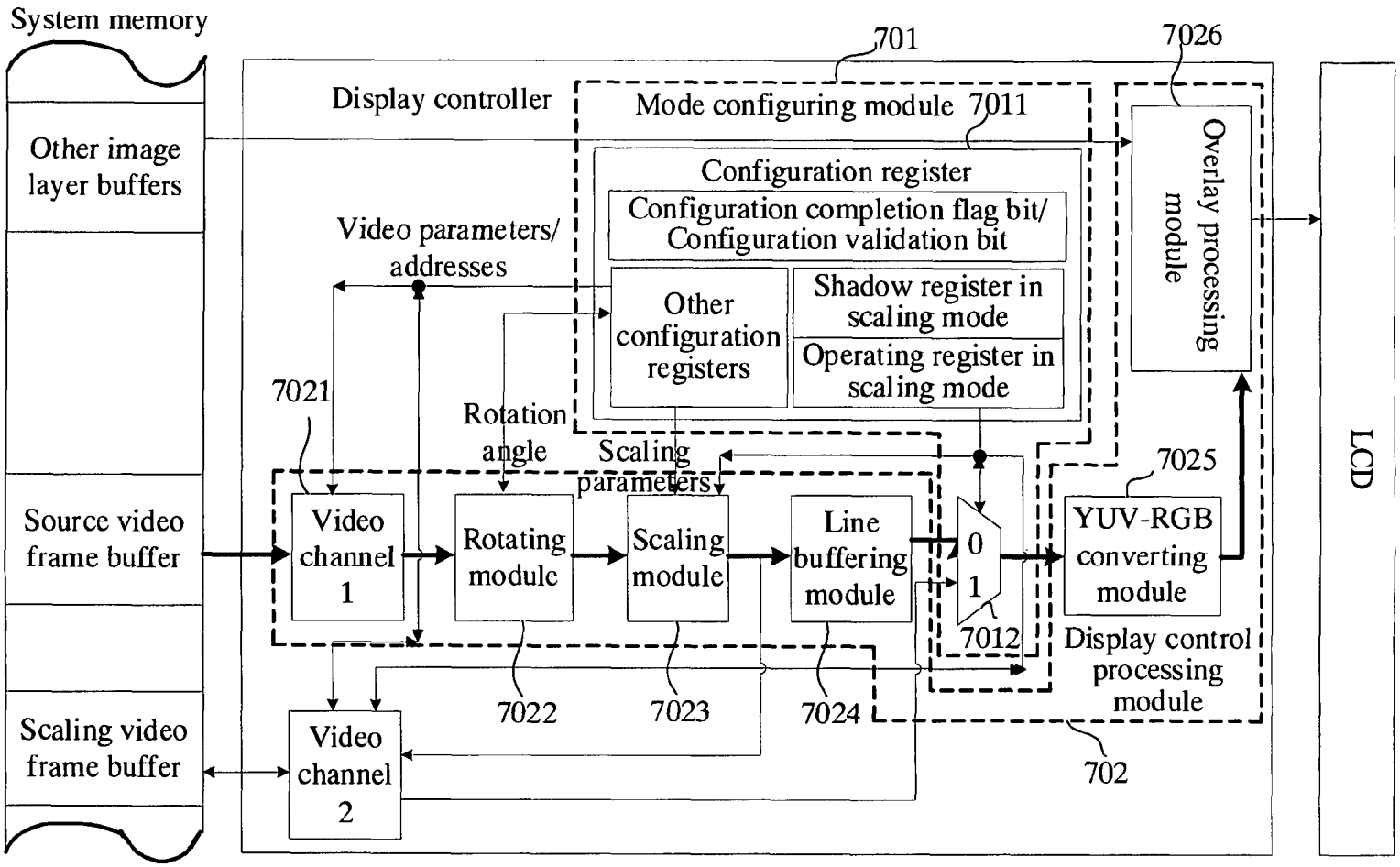
FIG. 8 shows a structure of a display controller that includes video streams in online mode in an embodiment of the present invention.
Figure 9:
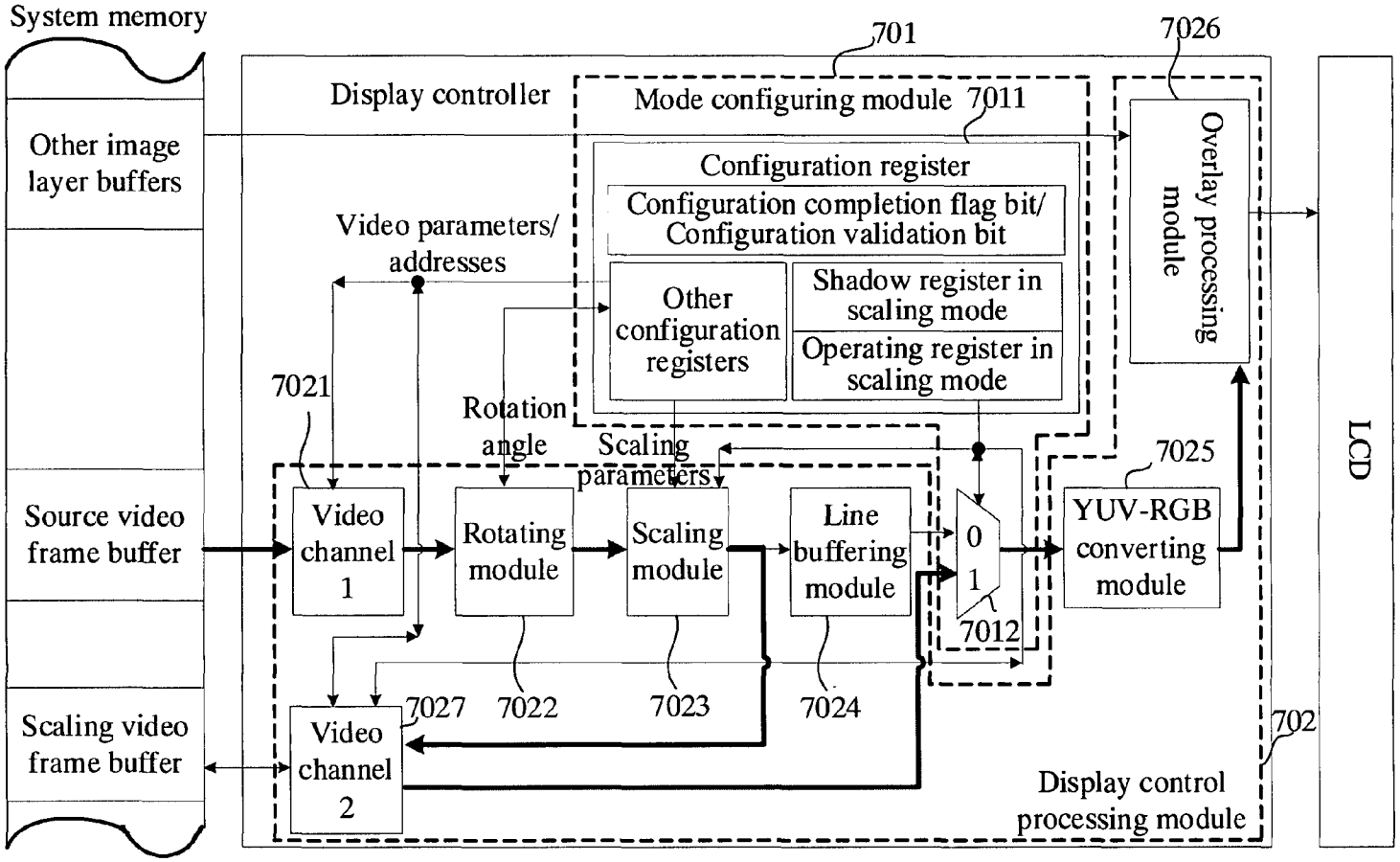
FIG. 9 shows a structure of a display controller that includes video streams in offline mode in an embodiment of the present invention.

FIG. 8 shows a structure of a display controller that includes video streams in online mode in an embodiment of the present invention, where the black solid lines and arrows indicate online video streams. FIG. 9 shows a structure of a display controller that includes video streams in offline mode in an embodiment of the present invention, where the black solid lines and arrows indicate offline video streams.

As shown in FIG. 7, FIG. 8, and FIG. 9, the mode configuring module 701 may include a configuration register 7011 and a mode selecting module 7012.

The configuration register is adapted to notify the mode selecting module when determining that the video layer needs to scale a video image.

The mode selecting module 7012 is adapted to: set the offline mode when the preset policy is met; and set the online mode when the preset policy is not met. It is understandable that the mode selecting module 7012 is adapted to set the video layer to online mode or offline mode. In this embodiment, when the mode selecting module is set to 0, the display controller is in online mode; when the mode selecting module is set to 1, the display controller is in offline mode.

In addition, the configuration register 7011 is further adapted to configure the parameters of the video layer after determining that the previous display configuration is validated and before determining whether the video layer needs to scale the video image; or configure the parameters of the video layer after the video layer is set to online mode or offline mode according to the preset policy.

The foregoing parameters of the video layer include at least: relationship between the video layer and other image layers, video input format, video rotation angle, scaling video frame buffer address, and scaling parameter register.

As shown in FIG. 7 and FIG. 8, in online mode, the display control processing module 702 may include a first video channel 7021, a rotating module 7022, a scaling module 7023, a line buffering module 7024, a format converting module 7025, and an overlay processing module 7026.

The first video channel 7021 is adapted to read the source video image frame outside the display controller in real time. Specifically, the first video channel 7021 is adapted to read the source video image from the source video image buffer in real time.

The rotating module 7022 is adapted to rotate the source video image frame read by the first video channel.

The scaling module 7023 is adapted to scale the rotated video image.

The line buffering module 7024 is adapted to buffer the scaled video image.

The format converting module 7025 is adapted to: obtain the video image from the line buffering module, and convert the format of the video image.

The overlay processing module 7026 is adapted to: overlay the converted video image with other image layers for displaying, and output the processed video image.

As shown in FIG. 7 and FIG. 9, in offline mode, the display control processing module 702 includes:

a first video channel 7021, adapted to read a source video image frame from the source video frame buffer, and specifically, adapted to read a source video image from the source video image buffer;

a rotating module 7022, adapted to rotate the source video image frame read by the first video channel.

a scaling module 7023, adapted to: scale the rotated video image, and buffer the scaled video image through a second video channel;

the second video channel 7027, adapted to read the buffered video image frame when an LCD frame synchronization signal arrives, and specifically, adapted to read the buffered video image frame from the scaling video buffer when the LCD frame synchronization signal arrives;

a format converting module 7025, adapted to convert the format of the video image frame read from the scaling video buffer; and an overlay processing module 7026, adapted to: overlay the converted video image with other image layers for displaying, and output the processed video image.

The first video channel shown in FIG. 8 and FIG. 9 7021 may further include a redundant line judging module and a reading unit.

The redundant line judging module is adapted to: identify a redundant line of the read source video image, and notify the reading unit of the identified redundant line.

The reading unit is adapted to: skip the redundant line in the source video image, and read the non-redundant lines of the video image frame.

With the display controller provided in this embodiment, the source video image is scaled in a high ratio range according to the online mode or offline mode, thus reducing the display power consumption. In addition, the bus clock frequency and the operating clock frequency of the scaling engine are within a range that can be implemented physically. When the mode is switched according to the principle of minimizing the data access load of the system memory, the data access load of the system memory by the display system can be reduced, thus reducing the power consumption of the system memory. When the mode is switched according to the principle of minimizing the bus clock frequency of the video layer, the bus clock frequency of the video layer can be reduced, thus reducing the total power consumption of the display system.

Further, the redundant line can be pre judged and skipped directly, and only the valid lines need to be read for subsequent processing. Thus, the operating clock frequency may be reduced, and the data access load of the system memory may also be further reduced.

Figure 10:
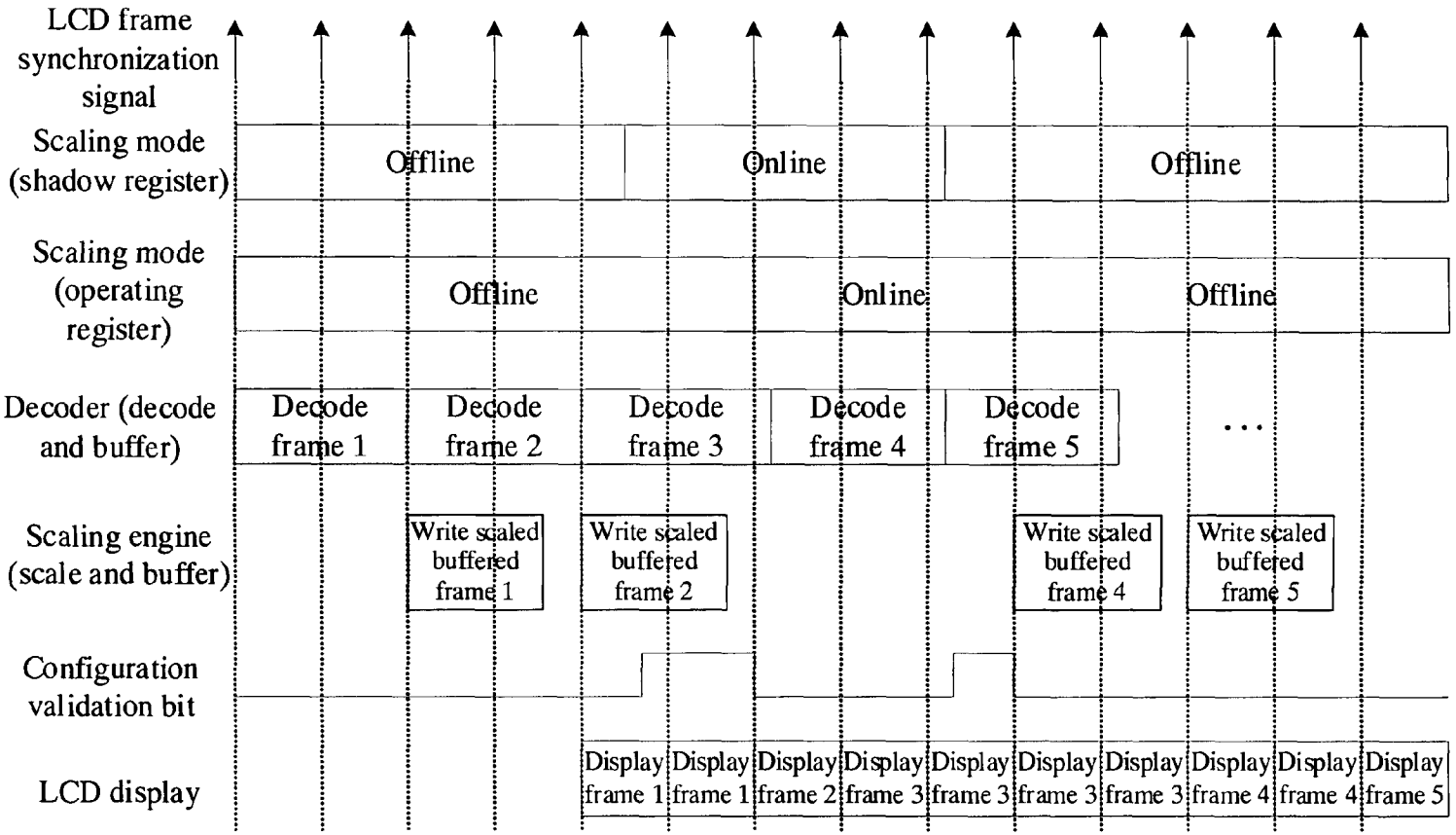
FIG. 10 shows a hardware process of switching between modes in an embodiment of the present invention.

FIG. 10 shows a hardware process of switching between modes in an embodiment of the present invention. In this embodiment, it is supposed that the component for buffering a source video image frame is a decoder, the decoding frame rate of which is half of the display frame rate. In scaling mode, two registers are available: shadow register and operating register.

When the video layer attribute is changed, the software writes the mode configuration to the shadow register in scaling mode, and sets the configuration validation flag bit to 1 after configuring other parameters of the video layer. When an LCD frame synchronization signal arrives, if the operating register is offline but the shadow register is online (that is, switching from the offline mode to the online mode is required), the display controller must copy the value of the shadow register to the operating register and enter the online mode after a complete frame that is being scaled in offline mode is written to the scaling video frame buffer (that is, after the scaled buffered frame 2 is written) and before the next LCD frame synchronization signal arrives. In addition, the hardware sets the configuration validation flag bit to zero. If the operating register is online but the shadow register is offline (that is, switching from the online mode to the offline mode is required), the display controller copies the value of the shadow register to the operating register when the LCD frame synchronization signal arrives and enters the offline mode. In addition, the hardware sets the configuration validation flag bit to zero. It is understandable that the new configuration is validated after the hardware sets the configuration validation flag bit to zero.

Thus, the value of the operating register in scaling mode represents the current operating mode of the display controller. In offline mode, the display controller reads a current decoded frame from the source video frame buffer after the decoder decodes a frame; the display controller rotates and scales the frame, and writes the rotated and scaled frame to the scaling video frame buffer. In addition, after the LCD frame synchronization signal arrives, the display controller reads the current frame from the scaling video frame buffer, converts the format of the frame from YUV to RGB, overlays the converted frame with other image layers, and sends the overlaid frame to the LCD for displaying. In online mode, the display controller reads the current frame from the source video frame buffer; the display controller rotates and scales the current frame in real time, converts the format of the frame from YUV to RGB, overlays the converted frame with other image layers, and sends the overlaid frame to the LCD for displaying.

In offline mode, the display controller reads the source video frame after the decoders decodes a frame and the time stamp of the frame matches the current time or when the mode is changed from the online mode to the offline mode at the LCD frame synchronization time. After scaling the source video frame, the display controller writes the scaled source video frame to the scaling video frame buffer. Thus, the scaling frame rate in offline mode is the same as the frame rate of the decoder. The display controller, however, reads the frame from the scaling frame buffer according to the display frame rate synchronous with the LCD, converts the format of the frame from YUV to RGB, overlays the frame, and sends the overlaid frame to the LCD for displaying. Table 2 summarizes the bus clock frequencies needed by the video layer in offline mode based on the following assumptions: the decoding frame rate is 30 frames per second; the bus read delay is 35 clock periods; and the outstanding depth of the video channel is 1. According to Table 2, the bus clock frequencies needed by the video layer in offline scaling mode are rather low. Thus, any scaling ratio may be implemented physically.

TABLE 2

| DSU Frequency | | Source Image Resolution | | | |
|---|---|---|---|---|---|
| Requirement: MHz | | VGA | D1 | XGA | 720P |
| Target image resolution | VGA | 16.42 | 20.65 | 35.29 | 40.61 |
| | D1 | 17.93 | 22.16 | 36.80 | 42.12 |
| | XGA | 23.16 | 27.39 | 42.02 | 47.35 |
| | 720P | 25.06 | 29.29 | 43.93 | 49.25 |

In online mode, only a maximum scaling ratio of 1.73 needs to be implemented according to the principle of minimizing the data access load of the system memory. Thus, the transient bandwidth of the system memory needed by the video layer is only 1.73 times the transient bandwidth when no scaling is performed. This ratio is also in a reasonably implemented range. Table 3 lists the bus clock frequency needed by the video layer when the WXGA is displayed vertically and scaled down by 1.73 times online and the outstanding depth of the video channel is 2. Table 4 lists the bus clock frequency needed by the video layer when the WXGA is displayed horizontally and scaled down by 1.73 times online and the outstanding depth of the video channel is 2. In general, the bus read delay is within 25 clock periods. According to Table 3 and Table 4, the bus clock frequency required by the video layer within 25 clock periods is smaller than 140 MHz.

TABLE 3

| | Bus Read Delay/Bus Efficiency | | | | | | | | | | |
|---|---|---|---|---|---|---|---|---|---|---|---|
| Video Resolution | 0 100.0% | 5 69.6% | 10 42.1% | 15 30.2% | 20 23.5% | 25 19.3% | 30 16.3% | 35 14.2% | 40 12.5% | 45 11.2% | 50 10.1% |
| QVGA(0.08M) | 8.4 | 12.1 | 19.9 | 27.8 | 35.7 | 43.5 | 51.4 | 59.3 | 67.1 | 75.0 | 82.9 |
| CIF(0.1M) | 10.1 | 14.5 | 23.9 | 33.4 | 42.8 | 52.2 | 61.7 | 71.1 | 80.6 | 90.0 | 99.4 |
| VGA(0.3M) | 16.8 | 24.1 | 39.9 | 55.6 | 71.3 | 87.1 | 102.8 | 118.5 | 134.3 | 150.0 | 165.7 |
| D1(0.4M) | 20.1 | 29.0 | 47.8 | 66.7 | 85.6 | 104.5 | 123.4 | 142.2 | 161.1 | 180.0 | 198.9 |
| XGA(0.8M) | 26.9 | 38.6 | 63.8 | 88.9 | 114.1 | 139.3 | 164.5 | 189.6 | 214.8 | 240.0 | 265.2 |
| 720p(0.9M) | 25.2 | 36.2 | 59.8 | 83.4 | 107.0 | 130.6 | 154.2 | 177.8 | 201.4 | 225.0 | 248.6 |

TABLE 4

| | Bus Read Delay/Bus Efficiency | | | | | | | | | | |
|---|---|---|---|---|---|---|---|---|---|---|---|
| Video Resolution | 0 100.0% | 5 69.6% | 10 42.1% | 15 30.2% | 20 23.5% | 25 19.3% | 30 16.3% | 35 14.2% | 40 12.5% | 45 11.2% | 50 10.1% |
| QVGA(0.08M) | 5.2 | 7.5 | 12.5 | 17.4 | 22.3 | 27.2 | 32.1 | 37.0 | 42.0 | 46.9 | 51.8 |
| CIF(0.1M) | 6.3 | 9.0 | 14.9 | 20.8 | 26.7 | 32.6 | 38.5 | 44.4 | 50.3 | 56.2 | 62.1 |
| VGA(0.3M) | 10.5 | 15.1 | 24.9 | 34.7 | 44.6 | 54.4 | 64.2 | 74.1 | 83.9 | 93.7 | 103.6 |
| D1(0.4M) | 12.6 | 18.1 | 29.9 | 41.7 | 53.5 | 65.3 | 77.1 | 88.9 | 100.7 | 112.5 | 124.3 |
| XGA(0.8M) | 16.8 | 24.1 | 39.9 | 55.6 | 71.3 | 87.1 | 102.8 | 118.5 | 134.3 | 150.0 | 165.7 |
| 720p(0.9M) | 15.7 | 22.6 | 37.4 | 52.1 | 66.9 | 81.6 | 96.4 | 111.1 | 125.9 | 140.6 | 155.4 |

The online mode and the offline mode may also be selected or switched according to the following principle of minimizing the bus clock frequency needed by the video layer: using the offline mode to scale down the video image; using the online mode to scale up the video image. Table 5 lists the bus clock frequency needed by the video layer when the switching of the WXGA vertical playing mode is based on the principle of minimizing the bus clock frequency of the video layer and when the outstanding depth of the video channel is 2. Table 6 lists the bus clock frequency needed by the video layer when the switching of the WXGA horizontal playing mode is based on the principle of minimizing the bus clock frequency of the video layer and when the outstanding depth of the video channel is 2. In general, the bus read delay is within 25 clock periods. According to Table 5 and Table 6, the bus clock frequency required by the video layer within 25 clock periods is smaller than 81 MHz.

TABLE 5

| | Bus Read Delay/Bus Efficiency | | | | | | | | | | |
|---|---|---|---|---|---|---|---|---|---|---|---|
| Video Resolution | 0 100.0% | 5 69.6% | 10 42.1% | 15 30.2% | 20 23.5% | 25 19.3% | 30 16.3% | 35 14.2% | 40 12.5% | 45 11.2% | 50 10.1% |
| QVGA(0.08M) | 4.9 | 7.0 | 11.5 | 16.1 | 20.6 | 25.2 | 29.7 | 34.3 | 38.8 | 43.4 | 47.9 |
| CIF(0.1M) | 5.8 | 8.4 | 13.8 | 19.3 | 24.7 | 30.2 | 35.7 | 41.1 | 46.6 | 52.0 | 57.5 |
| VGA(0.3M) | 9.7 | 13.9 | 23.0 | 32.1 | 41.2 | 50.3 | 59.4 | 68.5 | 77.6 | 86.7 | 95.8 |
| D1(0.4M) | 11.6 | 16.7 | 27.6 | 38.6 | 49.5 | 60.4 | 71.3 | 82.2 | 93.1 | 104.0 | 115.0 |
| XGA(0.8M) | 15.5 | 22.3 | 36.9 | 51.4 | 66.0 | 80.5 | 95.1 | 109.6 | 124.2 | 138.7 | 153.3 |
| 720p(0.9M) | 14.6 | 20.9 | 34.6 | 48.2 | 61.8 | 75.5 | 89.1 | 102.8 | 116.4 | 130.1 | 143.7 |

TABLE 6

| | Bus Read Delay/Bus Efficiency | | | | | | | | | | |
|---|---|---|---|---|---|---|---|---|---|---|---|
| Video Resolution | 0 100.0% | 5 69.6% | 10 42.1% | 15 30.2% | 20 23.5% | 25 19.3% | 30 16.3% | 35 14.2% | 40 12.5% | 45 11.2% | 50 10.1% |
| QVGA(0.08M) | 3.0 | 4.4 | 7.2 | 10.0 | 12.9 | 15.7 | 18.6 | 21.4 | 24.3 | 27.1 | 29.9 |
| CIF(0.1M) | 3.6 | 5.2 | 8.6 | 12.1 | 15.5 | 18.9 | 22.3 | 25.7 | 29.1 | 32.5 | 35.9 |
| VGA(0.3M) | 6.1 | 8.7 | 14.4 | 20.1 | 25.8 | 31.5 | 37.1 | 42.8 | 48.5 | 54.2 | 59.9 |
| D1(0.4M) | 7.3 | 10.5 | 17.3 | 24.1 | 30.9 | 37.7 | 44.6 | 51.4 | 58.2 | 65.0 | 71.8 |
| XGA(0.8M) | 9.7 | 13.9 | 23.0 | 32.1 | 41.2 | 50.3 | 59.4 | 68.5 | 77.6 | 86.7 | 95.8 |
| 720p(0.9M) | 9.1 | 13.1 | 21.6 | 30.1 | 38.7 | 47.2 | 55.7 | 64.2 | 72.8 | 81.3 | 89.8 |

Figure 11:
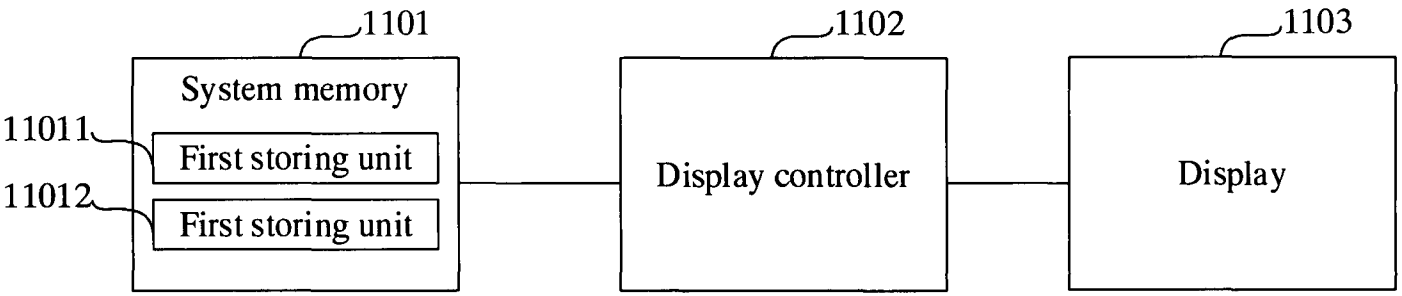
FIG. 11 shows a structure of a display terminal in an embodiment of the present invention.

An embodiment of the present invention provides a display terminal. As shown in FIG. 11, the display terminal includes:

a system memory 1101, adapted to store a video image frame;

a display controller 1102, adapted to: set the offline mode when the preset policy is met and the video layer needs to scale the video image; set the online mode when the preset policy is not met, read the video image from the system memory according to the online mode or offline mode, process the video image, and output the processed video image; and a display 1103, adapted to display the video image processed by the display controller.

The system memory 1101 may include:

a first storing unit 11011, adapted to store decoded or collected source video images; and a second storing unit 11012, adapted to act as the scaling video buffer used in offline mode.

The display 1103 may be an LCD or other displays.

The structure of the display controller 1102 and specific processes are shown in FIG. 2 to FIG. 10, and are not further described.

With the display terminal provided in this embodiment, the source video image is scaled in a high ratio range by selecting the online mode or offline mode, thus reducing the display power consumption. In addition, the bus clock frequency and the operating clock frequency of the scaling engine are within a range that can be implemented physically.

Those skilled in the art may understand that all or part of the steps in the foregoing embodiments may be performed by hardware instructed by a program. The program may be stored in a computer readable storage medium such as a read-only memory/random access memory (ROM/RAM), a magnetic disk or a compact disk.

Although the present invention has been described through several exemplary embodiments, the invention is not limited to such embodiments. It is apparent that those skilled in the art can make various modifications and variations to the invention without departing from the spirit and scope of the invention. The invention is intended to cover the modifications and variations provided that they fall in the scope of protection defined by the following claims or their equivalents.

What is claimed is:

1. A display method, comprising:

judging whether a preset policy is met when a video layer needs to scale a video image; if the preset policy is met, using an offline mode; otherwise, using an online mode; and processing a video image frame of the video image according to the online mode or the offline mode, and outputting the processed video image, wherein the online mode is a mode in which the video image frame is scaled in real time and the offline mode is a mode in which the video image frame is scaled asynchronously;

wherein processing the video image frame according to the online mode and outputting the processed video image comprises:

reading the video image frame from a source video frame buffer in real time, rotating the video image frame, scaling the video image frame, buffering the video image frame, and converting a format of the video image frame by lines; overlaying the converted data with other image layers for displaying, and outputting the processed video image.

2. The method of claim 1, wherein reading the video image frame comprises: judging whether the read video image frame is located at redundant lines; if so, skipping the redundant lines, and reading non-redundant lines of the video image frame.

3. A display method, comprising:

judging whether a preset policy is met when a video layer needs to scale a video image; if the preset policy is met, using an offline mode; otherwise, using an online mode; and processing a video image frame of the video image according to the online mode or the offline mode, and outputting the processed video image, wherein the online mode is a mode in which the video image frame is scaled in real time and the offline mode is a mode in which the video image frame is scaled asynchronously;

wherein processing the video image frame according to the offline mode and outputting the processed video image comprises:

reading the video image frame from a source video frame buffer; rotating and scaling the video image frame, and storing the scaled video image frame into a scaling video frame buffer; and reading a next video image frame when the current frame is processed and the next video image frame is available in the source video frame buffer; and when a liquid crystal display (LCD) frame synchronization signal arrives, reading the scaled video image frame from the scaling video frame buffer, converting the format of the scaled video image frame, overlaying the converted data with other image layers for displaying, and outputting the processed video image.

4. The method of claim 3, wherein reading the video image frame comprises: judging whether the read video image frame is located at redundant lines; if so, skipping the redundant lines, and reading non-redundant lines of the video image frame.

5. A display method, comprising:

judging whether a preset policy is met when a video layer needs to scale a video image; if the preset policy is met, using an offline mode; otherwise, using an online mode; and processing a video image frame of the video image according to the online mode or the offline mode, and outputting the processed video image, wherein the online mode is a mode in which the video image frame is scaled in real time and the offline mode is a mode in which the video image frame is scaled asynchronously;

wherein judging whether the preset policy is met includes judging whether the preset policy is met according to a principle of minimizing a data access load of a system memory by the video layer, further comprising:

presetting that a display frame rate is M times of an update frame rate of a video source and M is greater than 1, the preset policy is met when the horizontal and vertical scaling ratio of the source video image is greater than $\sqrt{(M+1)/(M-1)}$; the preset policy is not met when the horizontal and vertical scaling ratio of the source video image is smaller than $\sqrt{(M+1)/(M-1)}$.

6. A display method, comprising:

judging whether a preset policy is met when a video layer needs to scale a video image; if the preset policy is met, using an offline mode; otherwise, using an online mode; and processing a video image frame of the video image according to the online mode or the offline mode, and outputting the processed video image, wherein the online mode is a mode in which the video image frame is scaled in real time and the offline mode is a mode in which the video image frame is scaled asynchronously;

wherein judging whether the preset policy is met includes judging whether the preset policy is met according to a principle of minimizing a bus clock frequency of the video layer, further comprising:

the preset policy is met when the source video image is scaled down vertically; and the preset policy is not met when the source video image is scaled up vertically.

7. A display method, comprising:

judging whether a preset policy is met when a video layer needs to scale a video image; if the preset policy is met, using an offline mode; otherwise, using an online mode;

processing a video image frame of the video image according to the online mode or the offline mode, and outputting the processed video image, wherein the online mode is a mode in which the video image frame is scaled in real time and the offline mode is a mode in which the video image frame is scaled asynchronously; and judging whether a display configuration is already validated; if the display configuration is already validated, judging whether the video layer needs to scale the video image; otherwise, judging whether the video layer needs to scale the video image after a previous display configuration is validated.

8. The method of claim 7, wherein after setting the video layer to online mode or offline mode according to the preset policy, the method further comprises: configuring parameters of the video layer, enabling the video layer, and setting a configuration completion bit.

9. The method of claim 7, wherein parameters of the video layer comprise: a parameter of a relationship between the video layer and other image layers, a parameter of a video input format, a parameter of a video rotation angle, a parameter of a scaling video frame buffer address, and a parameter of a scaling parameter register.

10. A display controller, comprising:

a mode configuring module, when a video layer needs to scale a video image, adapted to: set an offline mode if a preset policy is met; set an online mode if the preset policy is not met; and a display control processing module, adapted to: control the display controller to process a video image frame of the video image according to the online mode or the offline mode based on configuration details of the mode configuring module, and output the processed video image;

wherein the mode configuring module comprises:

a configuration register, adapted to notify a mode selecting module when determining that the video layer needs to scale the video image; and the mode selecting module, adapted to: set the offline mode when the preset policy is met and set the online mode when the preset policy is not met.

11. The display controller of claim 10, wherein the configuration register is further adapted to: configure parameters of the video layer after the video layer is set to online mode or offline mode according to the preset policy.

12. A display controller, comprising:

a mode configuring module, when a video layer needs to scale a video image, adapted to: set an offline mode if a preset policy is met; set an online mode if the preset policy is not met; and a display control processing module, adapted to: control the display controller to process a video image frame of the video image according to the online mode or the offline mode based on configuration details of the mode configuring module, and output the processed video image;

wherein parameters of the video layer comprise: a parameter of a relationship between the video layer and other image layers, video input format, a parameter of a video rotation angle, a parameter of a scaling video frame buffer address, and a parameter of a scaling parameter register.

13. A display controller, comprising:

a mode configuring module, when a video layer needs to scale a video image, adapted to: set an offline mode if a preset policy is met; set an online mode if the preset policy is not met; and a display control processing module, adapted to: control the display controller to process a video image frame of the video image according to the online mode or the offline mode based on configuration details of the mode configuring module, and output the processed video image;

wherein the display control processing module in online mode comprises:

a first video channel, adapted to read a video image frame outside the display controller in real time;

a rotating module, adapted to rotate the video image frame read by the first video channel;

a scaling module, adapted to scale the rotated video image from the rotating module;

a line buffering module, adapted to buffer the scaled video image from the scaling module;

a format converting module, adapted to obtain the scaled video image from the line buffering module, and convert the format of the video image; and an overlay processing module, adapted to overlay the converted video image from the format converting module with other image layers for displaying, and output the processed video image.

14. The display controller of claim 13, wherein the first video channel comprises:

a redundant line judging module, adapted to identify redundant lines of the read source video image, and notify a reading unit of identified redundant lines; and the reading unit, adapted to skip the redundant lines of the source video image, and read the non-redundant lines of the video image frame.

15. A display controller, comprising:

a mode configuring module, when a video layer needs to scale a video image, adapted to: set an offline mode if a preset policy is met; set an online mode if the preset policy is not met; and a display control processing module, adapted to: control the display controller to process a video image frame of the video image according to the online mode or the offline mode based on configuration details of the mode configuring module, and output the processed video image;

wherein the display control processing module in offline mode comprises:

a first video channel, adapted to read a video image frame from a source video frame buffer;

a rotating module, adapted to rotate the video image frame read by the first video channel;

a scaling module, adapted to: scale the rotated video image frame from the rotating module, and store the scaled video image frame in a scaling video frame buffer through a second video channel;

the second video channel, adapted to read the scaled video image frame in the scaling video frame buffer when a liquid crystal display (LCD) frame synchronization signal arrives;

a format converting module, adapted to convert the format of the buffered video image frame from the scaling video frame buffer; and an overlay processing module, adapted to overlay the converted video image frame from the format converting module with other image layers for displaying, and output the processed video image.

16. The display controller of claim 15, wherein the first video channel comprises:

a redundant line judging module, adapted to identify redundant lines of the read source video image, and notify a reading unit of identified redundant lines; and the reading unit, adapted to skip the redundant lines of the source video image, and read the non-redundant lines of the video image frame.

17. A display terminal, comprising:

a system memory, adapted to store a video image frame of a video image;

a display controller, when a video layer needs to scale the video image, adapted to: set an offline mode if a preset policy is met; set an online mode if the preset policy is not met, read the video image frame from the system memory according to the online mode or offline mode, process the video image frame, and output the processed video image frame; and a display, adapted to display the processed video image frame by the display controller;

wherein the system memory comprises:

a first storing unit, adapted to store decoded or collected source video images; and a second storing unit, adapted to act as a scaling video buffer used in offline mode.

* * * * *